US011492572B2

(12) United States Patent
Colclasure et al.

(10) Patent No.: US 11,492,572 B2
(45) Date of Patent: Nov. 8, 2022

(54) EFFERVESCING COMPOSITIONS AND TABLETS FOR TREATING TOILETS

(71) Applicant: Alene Candles LLC, Milford, NH (US)

(72) Inventors: Brad Colclasure, Milford, NH (US); Tom Donnelly, Milford, NH (US); Max Donnelly, Milford, NH (US)

(73) Assignee: Alene Candles LLC, Milford, NH (US)

( * ) Notice: Subject to any disclaimer, the term of this patent is extended or adjusted under 35 U.S.C. 154(b) by 68 days.

(21) Appl. No.: 16/705,527

(22) Filed: Dec. 6, 2019

(65) Prior Publication Data

US 2021/0171881 A1 Jun. 10, 2021

(51) Int. Cl.

| | |
|---|---|
| ***C11D 17/00*** | (2006.01) |
| ***C11D 3/10*** | (2006.01) |
| ***C11D 3/386*** | (2006.01) |
| ***C11D 3/20*** | (2006.01) |
| ***C11D 3/50*** | (2006.01) |
| ***C11D 3/04*** | (2006.01) |
| *C11D 11/00* | (2006.01) |

(52) U.S. Cl.

CPC ..... *C11D 17/0056* (2013.01); *C11D 3/046* (2013.01); *C11D 3/10* (2013.01); *C11D 3/2086* (2013.01); *C11D 3/38609* (2013.01); *C11D 3/50* (2013.01); *C11D 17/0073* (2013.01); *C11D 11/0023* (2013.01)

(58) Field of Classification Search

CPC ..... C11D 17/0056; C11D 3/046; C11D 3/10

See application file for complete search history.

(56) References Cited

U.S. PATENT DOCUMENTS

| | | | | |
|---|---|---|---|---|
| 6,310,014 | B1 * | 10/2001 | Rau | A61Q 3/00 134/42 |
| 2005/0250667 | A1 * | 11/2005 | Quellet | C11D 17/06 510/444 |
| 2008/0113893 | A1 * | 5/2008 | Rowland | C11D 3/08 510/224 |
| 2012/0190607 | A1 * | 7/2012 | Olson | C11D 3/3761 510/405 |
| 2015/0132832 | A1 * | 5/2015 | Chan | C11D 3/384 435/264 |

FOREIGN PATENT DOCUMENTS

| | | | |
|---|---|---|---|
| EP | 0 199 404 | A1 | 10/1986 |
| EP | 0 292 623 | A1 | 11/1988 |
| EP | 0 516 200 | A1 | 2/1992 |
| WO | 91/06637 | A1 | 5/1991 |

* cited by examiner

*Primary Examiner* — Necholus Ogden, Jr.
(74) *Attorney, Agent, or Firm* — Norris McLaughlin PA

(57) ABSTRACT

The present composition relates to effervescing compositions used in the treatment of toilets, and in particular malodours which may emanate therefrom, as well as methods of making such compositions and methods of their use. The compositions may be in pulvurent form which may be a granular form, or may be in a solid form such as a tablet.

11 Claims, No Drawings

EFFERVESCING COMPOSITIONS AND TABLETS FOR TREATING TOILETS

This application claims the priority benefit of U.S. Ser. No. 62/777,371 filed 10. Dec. 2018, and incorporates by reference the entirety of that prior application.

The present composition relates to effervescing compositions used in the treatment of toilets, and in particular malodours which may emanate therefrom, as well as methods of making such compositions and methods of their use. The compositions may be in pulvurent form which may be a granular form, or may be in a solid form such as a tablet. In preferred embodiments the composition is in the form of a tablet.

The control of malodours emanating from the toilet, particularly subsequent to a prior use by a person and/or wherein residual urine and/or fecal deposits may remain, is desirable. Amongst the aspects of the invention are: a composition useful for the control of such malodours, a method of making such a composition and a method of treating a toilet from which malodours emanate to an ambient environment, particularly a bathroom or other closed space containing a toilet from which undesired malodors emanate. These and further aspects of the invention are disclosed in the following specification.

In a first aspect there is provided a substantially anhydrous, viz, comprising <5% wt. water, preferably <2% wt. water, more preferably <1% wt. water effervescing composition comprising the following constituents:

| | |
|---|---|
| alkali component of gas generator system | 35-55% wt. |
| acid components of gas generator system | 15-35% wt. |
| bulking constituent | 10-30% wt. |
| starch | 1.5-12% wt. |
| proteolytic enzyme | 0.005-3% wt. |
| fragrance | 0.1-5.5% wt. |
| water | 0.5-3% wt. |
| other optional constituents | q.s. to 100% wt. |

These effervescing compositions may be in a pulvurent, or granular form, may be contained in a water soluble or water dispersible coating or film, or may be formed into three-dimensional forms or articles, such as tablets, which three-dimensional forms are preferably frangible. In preferred embodiments the composition is in the form of a tablet.

In a second aspect there is provided a method of forming effervescing compositions which comprises the step of:

mixing measured amounts of the constituents comprised within the said effervescing compositions, and optionally thereafter mechanically forming a three-dimensional article from these constituents.

In a third aspect there is provided a method of controlling the emanation of malodors from a toilet into its ambient environment, the method comprising the step of:

supplying an effervescent composition as described herein into the water present in a toilet bowl, within which the composition effervesces and is dispersed.

These and further aspects of the invention will become evident from reading the following specification.

The effervescing compositions of the invention necessarily include a gas generator system which provides an effervescent effect, namely the evolution of a gas from a liquid resulting from a chemical reaction. This reaction can be between, for example, an acid and an alkali metal carbonate, to produce carbon dioxide gas. Any gas generator system may be used in the compositions of the invention. Preferably the gas generator system comprises both an acid component which is an acid or acid source, which in the presence of water is capable of reacting with an alkali component which is an alkali or an alkali source in order to produce a gas.

Preferably the resultant gas is oxygen, nitrogen dioxide or carbon dioxide but any other gas may also be formed.

The acid component may be any organic, mineral or inorganic acid, or mixtures thereof. Preferably the acid source is an organic acid. The acid component is preferably substantially anhydrous or non-hygroscopic and the acid is preferably also water-soluble or water dispersible. Exemplary useful acids include citric acid, maleic acid, maleic acid, fumaric acid, aspartic acid, glutaric acid, tartaric acid, succinic acid, adipic acid, monosodium phosphate, boric acid, and mixture thereof. Preferred are citric acid, maleic acid, maleic acid, and mixtures, especially citric acid which is both effective and widely commercially available.

The alkali component may be any suitable alkali or alkali source which has the capacity to react with the acid component when contacted with water to produce a gas. Exemplary alkali components include alkali metal carbonates, e.g, sodium carbonate, potassium carbonate, bicarbonate, sesquicarbonate, as well as perborates and percarbonates, as well as thereof. The relative amounts of the acid components to the alkali component may vary widely, however preferably the respective molar ratios of the acid component to the alkali component be within the range of 1-5:1-5, preferably in respective molar ratios of 1-2.5:1-2.5, more preferably in the range of the former to the latter of 1-1.5:1-1.5. Most preferably the acid component to alkali component be present in approximately equal molar ratios to ensure the evolution of the gas. In certain further particularly preferred embodiments the acid component, especially where the acid component is citric acid, is present in a molar excess such at that the respective molar ratio of the acid component to the alkali component is at least 1-2:1. An excess of the acid component provides for the delivery of the excess acid component not consumed in the gas formation reaction to the hard surface being cleaned, or to the water within which the acid component and the alkali component are contacted. The delivery of an excess acid component may advantageously decrease the pH of the water, or aid in the dissolution certain forms of certain surface stains including limescale which may have formed upon the inner surfaces of a toilet bowl. Especially preferred as the alkali component is a bicarbonate salt, particularly preferably sodium bicarbonate.

The total amount of the alkali component comprised in the effervescing compositions is 35-55% wt., with particularly preferred amounts disclosed in one or more the following examples.

The total amount of the acid component comprised in the effervescing compositions is 15-35% wt., with particularly preferred amounts disclosed in one or more the following examples.

The next essential constituent of the invention is a water soluble or water dispersible bulking constituent which is essentially inert with respect to the constituents of the gas generator system. Preferred, albeit non-limiting examples of such bulking constituents are alkaline earth metal salt or hydrate thereof, for example, chlorides such as sodium chloride, magnesium chloride and the like, sulfates such as magnesium sulfate, copper sulfate, sodium sulfate, zinc sulfate and the like, borax, borates such as sodium borate and the like, as well as others known to the art but not particularly recited herein.

The total amount of the water soluble or water dispersible bulking constituent comprised in the effervescing compositions is 10-30% wt., with particularly preferred amounts disclosed in one or more the following examples.

The next essential constituent of the inventive compositions are one or more water-soluble or water dispersible starches. Such are advantageously materials which when coming into contact with water, or at least dissolvable or dispersible within the water but preferably are also materials which swell to a controlled degree when coming into contact with water. Such property is advantageous as it induces the more rapid disintegration of a three-dimensional form of the effervescing composition according to the invention, and thereby may promote the more rapid and turbulent effervescing effect. Preferred are starch hydrozylates, and particularly preferred is maltodextrin or combination of dextrose with maltodextrin (preferably at a weight ratio of dextrose:maltodextrin of about 1:2). Other carbohydrates, starches and dextrins may be used as well. The inclusion of one or more water-soluble starches within the effervescing composition provides for advantageous effervescing effects as well as being a useful binder when effervescing compositions are tabletted or otherwise compressed into three-dimensional forms, particularly unit dosage forms.

The total amount of the one or more water-soluble or water dispersible starches comprised in the effervescing compositions is 1.5-12% wt., with particularly preferred amounts disclosed in one or more the following examples.

The next essential constituent of the effervescing compositions is a fragrance constituent, which may be based on natural and synthetic fragrances and most commonly are mixtures or blends of a plurality of such fragrances, optionally in conjunction with a carrier such as an organic solvent or a mixture of organic solvents in which the fragrances are dissolved, suspended or dispersed. By way of non-limiting example, natural fragrances include the extracts of blossoms (lily, lavender, rose, jasmine, neroli, ylang-ylang), stems and leaves (geranium, patchouli, petitgrain), fruits (anise, coriander, caraway, juniper), fruit peel (bergamot, lemon, orange), roots (nutmeg, angelica, celery, cardamon, costus, iris, calmus), woods (pinewood, sandalwood, guaiac wood, cedarwood, rosewood), herbs and grasses (tarragon, lemon grass, sage, thyme), needles and branches (spruce, fir, pine, dwarf pine), resins and balsams (galbanum, elemi, benzoin, myrrh, olibanum, opoponax). Animal raw materials, for example civet and beaver, may also be used. Typical synthetic perfume compounds are products of the ester, ether, aldehyde, ketone, alcohol and hydrocarbon type. Examples of perfume compounds of the ester type are benzyl acetate, phenoxyethyl isobutyrate, p-tert.butyl cyclohexylacetate, linalyl acetate, dimethyl benzyl carbinyl acetate, phenyl ethyl acetate, linalyl benzoate, benzyl formate, ethylmethyl phenyl glycinate, allyl cyclohexyl propionate, styrallyl propionate and benzyl salicylate. Ethers include, for example, benzyl ethyl ether while aldehydes include, for example, the linear alkanals containing 8 to 18 carbon atoms, citral, citronellal, citronellyloxyacetaldehyde, cyclamen aldehyde, hydroxycitronellal, lilial and bourgeonal. Examples of suitable ketones are the ionones, .alpha.-isomethylionone and methyl cedryl ketone. Suitable alcohols are anethol, citronellol, eugenol, isoeugenol, geraniol, linalool, phenylethyl alcohol and terpineol. The hydrocarbons mainly include the terpenes and balsams. However, it is preferred to use mixtures of different perfume compounds which, together, produce an agreeable fragrance. Other suitable perfume oils are essential oils of relatively low volatility which are mostly used as aroma components. Examples are sage oil, camomile oil, clove oil, melissa oil, mint oil, cinnamon leaf oil, lime-blossom oil, juniper berry oil, vetiver oil, olibanum oil, galbanum oil, labolanum oil and lavendin oil.

The total amount of the fragrance constituent comprised in the effervescing compositions is 0.1-5.5% wt., with particularly preferred amounts disclosed in one or more the following examples.

The effervescing compositions also comprise at least one proteolytic enzyme. Such include subtilisins which are obtained from particular strains of *B. subtilis* and *B. licheniformis* (subtilisin BPN and BPN'). One suitable protease is obtained from a strain of *Bacillus*, having maximum activity throughout the pH range of 8-12, developed and sold as ESPERASE by Novo Industries A/S of Denmark, hereinafter "Novo". The preparation of this enzyme and analogous enzymes is described in GB-A-1,243,784 to Novo. Non-limiting examples of further suitable proteases include ALCALASE, DURAZYM and SAVINASE from Novo as well as MAXATASE, MAXACAL, PROPERASE and MAXAPEM (protein engineered Maxacal) from Gist-Brocades. Proteolytic enzymes also encompass modified bacterial serine proteases, such as those described in EP-A-292623, in EP-A-199,404, in WO-A-91/06637 as well as in EP-A-516,200.

The proteolytic enzymes comprise 0.005-3% wt. of the effervescing composition.

Water forms the final essential constituent of the effervescing compositions, and forms not more than 5% wt., preferably not more than 2% wt., and especially preferably not more than 1% wt. of the effervescing composition. Such water is "added water", that is to say is to be distinguished from any "bound water" which may be present in any crystalline or more for us constituents of the invention and are not included in the foregoing percentages. Such "added water" desirably forms no more than 3% wt. of the effervescing composition and if added, is frequently only added in such minor amounts particularly where a quantity of the effervescing composition is processed and ultimately tablet it to form unit dosage forms there from. The addition of this minor amount of water frequently aides and lubrication of the other solid constituents and when present such minor amounts does not deleterious the effect the gas generator system or component parts thereof. The water may be from any source, but is advantageously deionized or distilled water, although water from a municipal water source may also be used.

The remaining balance to quantum sufficient (viz., to 100% wt.) of the composition may be one or more optional constituents. In certain preferred embodiments, the effervescing compositions comprise not more than 0.1% wt. added water, more preferably not more than 0.05% wt. added water, and especially preferably comprise not more than 0.001% wt. added water, and particularly comprise no added water. The "added water" amounts exclude any water which may be incidentally absorbed from the surrounding atmosphere.

The effervescing compositions may optionally comprise one or more further filler constituents, preferably based on materials which inert with respect to the gas generating constituent and which also are inert with respect to the antimicrobial constituent. Such are provided as comminuted or particulate materials. These inert filler materials may be compounds or materials which may have limited solubility in water and/or in organic solvents. Non-limiting examples of such include silicates such as sodium silicate and aluminum silicate, chemically modified magnesium aluminum silicate, hydrated aluminum silicate, fumed silica, silica dioxide, talc (layered magnesium silicate), alkali metasilicates, e.g., sodium metasilicate and the like, perlite, pumice, feldspar, calcium phosphate, chalk, kaolin, carbon black, insoluble sulfates such as sodium sulfate, and mixtures thereof. Further filler constituents which may also be present in the effervescing compositions include one or more of: talc, kaolin, bentonite clay, carbonate or sulfate salts, as well as sugars, and crystalline polyols such as sorbitols. Fillers constituents which have the ability to adsorb hydrophobic materials, such as components forming parts of the fragrance constituent are advantageously included in the inventive compositions.

The effervescing compositions may include, and in certain preferred embodiments necessarily includes one or more surfactants. Such surfactants may be selected from anionic, nonionic, cationic, and amphoteric surfactants. However, anionic surfactants are preferred as they typically provide a visible foaming benefit when the effervescing compositions are contacted with water contained within the bowl of a toilet.

Nonlimiting examples of anionic surfactants include one or more of: alkali metal salts, ammonium salts, amine salts, or aminoalcohol salts of one or more of the following compounds (linear and secondary): alcohol sulfates and sulfonates, alcohol phosphates and phosphonates, alkyl sulfates, alkyl ether sulfates, sulfate esters of an alkylphenoxy polyoxyethylene ethanol, alkyl monoglyceride sulfates, alkyl sulfonates, olefin sulfonates, paraffin sulfonates, beta-alkoxy alkane sulfonates, alkylamidoether sulfates, alkylaryl polyether sulfates, monoglyceride sulfates, alkyl ether sulfonates, ethoxylated alkyl sulfonates, alkylaryl sulfonates, alkyl benzene sulfonates, alkylamide sulfonates, alkyl monoglyceride sulfonates, alkyl carboxylates, alkyl sulfoacetates, alkyl ether carboxylates, alkyl alkoxy carboxylates having 1 to 5 moles of ethylene oxide, alkyl sulfosuccinates, alkyl ether sulfosuccinates, alkylamide sulfosuccinates, alkyl sulfosuccinamates, octoxynol or nonoxynol phosphates, alkyl phosphates, alkyl ether phosphates, taurates, N-acyl taurates, fatty taurides, fatty acid amide polyoxyethylene sulfates, isethionates, acyl isethionates, and sarcosinates, acyl sarcosinates, or mixtures thereof. Generally, the alkyl or acyl radical in these various compounds comprise a carbon chain containing 12 to 20 carbon atoms.

Particularly preferred anionic surfactants include sulfated and sulfonated surfactants, especially sodium lauryl ether sulfate, and fatty alkyl isethionates and fatty acid glutamates, especially sodium cocoyl isethionate and sodium cocoyl glutamate.

When present, the total amount of these surfactant(s) present in the effervescing compositions is to 3% wt., with particularly preferred anionic surfactants and their amounts disclosed in one or more the following examples.

The effervescing compositions may be produced by simple mixing of measured amounts of the individual constituents which are preferably also supplied in the form of a granulated, or pulvurent forms, and mixed such as by blending, tumbling or any other technique which provides a homogeneous blend of the constituents. Pulvurent effervescing compositions may be subsequently formed into three-dimensional solid form such as by compression of tabletting according to procedures known to the art. Tablets of any geometry, such as in a wafer form, spherical, cylindrical, flattened spherical, cube, cuboid, granulated particles may be formed. In such a three-dimensional solid form the quantity of the effervescing composition is desirably a unit dose form.

Unit doses of the effervescing composition or advantageously in the range of about 3-10 grams, preferably at least about 3.5, 4, 4.5, 5, 5.5, 6, 6.5, 7, 7.5, 8, 8.5, 9, 9.5 and 10 grams.

The effervescing compositions may also be packaged into any suitable container, and dispensed therefrom as required. They may be packaged as one or more unit dose forms, or may be packaged as pulvurent or granular forms. Nonlimiting examples of such dispensers include bulk dispensers such as bottles, jars, and bags, breachable single-dosage form packages such as paper, foil, plastic or multilaminate packaging materials including "tear-open" type packages which are breached to allow access to and dispensing of a quantity of the effervescing composition, preferably unit dose form thereof such as a measured quantity of the effervescing composition, but most advantageously as a compacted or tabletted article.

Further dispensers, e.g., unit dose dispensers, may be in the form of water dispersible, water miscible or water soluble sachet or pouch or water-soluble package containing a quantity of the effervescing compositions. Such may be formed from a water soluble material, such as a water soluble or water dispersible polymeric film (e.g. polyvinyl alcohol), or alternately may be formed from a water insoluble material, such as a water insoluble polymeric film. Such may be flexible films, or may be rigid films or bodies formed from such water soluble materials. Additionally the sachet, pouch or package may be formed in a manner where only part of the sachet is physically breachable or only part of the sachet, pouch or package is water soluble or dispersible which encases a quantity of the effervescing compositions. When such a unit dose dispenser is added to a unit quantity of water, the water soluble polymer dissolves and releases the effervescing compositions to the water which is dissolved or dispersed within. Thus a further aspect of the invention provides a closed, water dispersible, a water miscible or a water soluble sachet or pouch containing the inventive composition as described herein. Such a sachet may be formed or include a water soluble water dispersible polymeric film, such as polyvinyl alcohol which can be used as either a coating layer upon the effervescing compositions, particularly when such are provided in the form of a three-dimensional form such as a tablet wherein the coating layer can be provided by spraying or dipping the three-dimensional form, or alternately one or more preformed layers of a water-soluble polymeric film may be formed into sachets which are sealed around a quantity of the effervescing composition which may optionally be in a solid three-dimensional form but advantageously is a unit dose of pulvurent effervescing composition.

In a further embodiment the unit dose dispensers may be rigid capsules formed of water soluble materials, e.g, gelatine capsules or other preformed rigid encapsulating containers which are breachable, or soluble, in water.

In a preferred embodiment, the effervescing compositions are tabletted into a shaped body or article, such as a pill, tablet or other three-dimensional body or article having an outer surface surrounding an interior volume. Preferably such a tabletted shaped body is used as a single dose form. Such tabletted shaped bodies or articles may be provided in a carrier or tray, or may be individually provided such as in an overwrap of a material, preferably a water impermeable material, and/or the outer surface may be coated with a water soluble polymer or other water soluble material which provides a tablet coating which limits the transmission of ambient air humidity to the interior volume.

When the effervescing compositions are provided as tabletted or shaped bodies or articles, i.e, tablets, they may have a homogenous composition throughout their volume. Alternately, effervescing compositions may have differing layers of different material compositions which are homogenous within each layer (or volume), but differ from one layer (of volumes) to the next.

In use, a unit dose form of the effervescing composition, or alternately a quantity of the effervescing composition (particularly when such is in a pulvurent or granular form) is dispensed to the water at the base of a toilet bowl, and see effervescing composition when coming into contact with the water rapidly begins effervescing due to the action of the gas generator component thereby also concurrently dispensing the remaining constituents forming part of the effervescing composition to the water, as well as to the immediate ambient environment including the headspace above the water level within the toilet bowl. The rapid effervescence releases the remaining constituents and inorganic or hydrophobic constituents including but not limited to the fragrance constituent form a layer, preferably a continuous layer of a hydrophobic film upon the top surface of the water present at the base of the toilet bowl. This film forms a barrier above the water, potentially trapping unwanted sense and or malodorous from entry into the ambient environment. Rapid effervescence advantageously also rapidly delivers the fragrance constituent to the headspace, and the immediate ambient environment of the toilet bowl thus providing to a consumer user a pleasing olfactory benefit.

In one mode of use, the effervescing composition is provided to the water of the toilet bowl immediately prior to use of the toilet bowl by the consumer. In another mode of use the effervescing composition is provided to the water of the toilet bowl immediately subsequent to flushing of the toilet bowl by the consumer.

Advantageously, the effervescing composition is used within 120 seconds, preferably within 90 seconds prior to the use of the toilet bowl by a consumer (to defecate and/or urinate), whereby the rapid effervescing effects and concurrent delivery of the fragrance composition to the headspace and ambient environment is best realized. Such provides a perceived "freshness" benefits to the toilet bowl immediately prior to its use by the consumer. Additionally, where one or more surfactants are present within the effervescing composition a modest cleaning benefit might also be imparted to the toilet bowl concurrent with the delivery of the fragrance to the headspace. Additionally, wherein there is a stoichiometric excess of the organic acid of the gas generator component, this excess acid may advantageously reduce the pH of the water within the toilet bowl, and provide a cleaning benefit particularly which may be useful in controlling or removing hard water stains, soap scum, or other deposits present within, or upon surfaces of the toilet bowl.

Certain embodiments of the invention, including certain particularly preferred embodiments of the invention are disclosed in the following examples.

EXAMPLES

An effervescing composition was produced by mixing the indicated constituents, each of which was in a comminuted, powered or particulate form, as outlined in Table 1 by adding measured amounts of the individual constituents into an open mouthed vessel, and thereafter manually mixing the constituents until a homogenous mixture resulted. Each of the constituents was used "as supplied" from their respective supplier. Typically, mixing required 5-10 minutes in order to produce a homogenous blend. In the following Table 1, the amounts listed are % wt. of the indicated constituent.

TABLE 1

| | Ex. 1 (% wt) | Ex.2 (% wt) |
|---|---|---|
| sodium bicarbonate | 53.97 | 56 |
| citric acid | 30 | 30 |
| sodium chloride | 6.5 | 6.5 |
| maltodextrin | 2.5 | 2.5 |
| fragrance | 3.53 | 3.5 |
| proteolytic enzyme | 2.5 | 0.5 |
| water | to 1.0, or q.s. | to 1.0, or q.s. |

The identity of the specific constituents are identified on the following Table 2. In addition to the identity of the constituent, the % wt. active and in some instances the source of the constituent is also indicated.

TABLE 2

| | |
|---|---|
| sodium bicarbonate | sodium bicarbonate (powder), laboratory grade (100% wt. actives) |
| citric acid | citric acid (powder), laboratory grade (100% wt. actives) |
| sodium chloride | sodium chloride (powder), laboratory grade (100% wt. actives) |
| maltodextrin | maltodextrin (powder), laboratory grade (100% wt. actives) |
| fragrance | proprietary fragrance composition |
| proteolytic enzyme | Proteolytic enzyme (liquid) (supplier proprietary % wt. actives) |
| water | deionized or distilled water, 100% wt. actives |

After being produced 12 grams of the composition was tabletted into a tablet having the following dimension (10 mm thick, 24 mm radius) using a metal mold. The tablets were formed using a pressure of 60 psi. Subsequently when a tablet was tossed into the bottom of a toilet bowl containing water, the tablet rapidly effervesced and disintegrated. The disintegrated tablet compositions are believed to have formed a hydrophobic layer upon the surface of the water present in the toilet bowl, which aided in trapping malodors emanating from materials in the water of the toilet bowl into the headspace above, and into the ambient environment.

Compositions according to Ex. 2 were evaluated for their ability to counteract specific malodours based on the following malodor sources:

(a) pumpkin puree—supplied as "Libby's 100% Pure Pumpkin Puree (b) fish sauce—supplied as "Thai Kitchen Premium Fish Sauce"

(c) minced garlic—supplied as "Spice World Minced Garlic"

of which equal amounts (aliquots) were used in each of the following tests, in which samples of compositions of the invention, per Ex. 2 and several comparative examples were also evaluated; one of the tests was performed without the use of any treatment composition and was undertaken to establish a 'baseline' malodour of the malodour sources (a), (b), (c). The tests were undertaken according to the following protocol, and evaluation was undertaken by a group of eight (8) trained panelists who ranked the intensity of the perceived malodor on a relative scale of 0 to 5 with "5" being the most offensive/intense malodour, to a minimum value of "0" representing no perception (nasal) of the malodour.

Test: Malodour Perception

The test was undertaken to evaluate the speed of dissolution of a sample composition, viz, either a tablet formed of the composition of Ex. 2, or one or more "control" or "comparative" compositions which were as follows:

Control 1: no composition used;

Comparative 2: "Pottymint—La Fluer (Jasmine and Honeysuckle)" which is a commercially available tablet product;

Comparative 3: "Alka-Seltzer—Original (unfragranced)", which is a commercially available tablet product;

Comparative 4: "Poo-Pourri—Merry Spritzmas (Peppermint, Vanilla and Citrus) which is commercially available pump spray product.

Each of Comparative 2 and 3 were used in their commercially available form, namely 1 tablet of the commercial product.

Comparative 4 was sprayed from its container onto the surface of the water.

The Example 2 composition was in tabletted form having a mass of between 6.5 and 7 grams, and the fragrance of the composition was based on eucalyptus and spearmint.

In the test, at the indicated time intervals, i.e, prior to the addition of the Ex. 2, Control or any of the Comparative compositions into the water, the perceived malodour sensed by each of the panelists, and the perceived fragrance sensed by each of the panelists was also evaluated an noted on a relative scale of "5" which was the maximum perceived intensity of malodor or fragrance, to a "0" which was no perceived intensity of malodor or fragrance.

For each of the tests, three (3) containers, 1 liter glass beakers were used, to each was charged 750 ml of room temperature (approx. 20 deg.C.) water.

Also dosage samples were prepared, namely 40 grams of the (a) pumpkin puree, 4 grams of the (b) fish sauce and 10 grams of the (c) minced garlic were separately placed in separate containers, and sealed with a vapor barrier plastic film.

Next, a sensory panelist next individually evaluated the malodour perception of each of the (a) pumpkin puree, the (b) fish sauce and (c) minced garlic dosage samples by placing each approximately 24 inches (approx. 60 cm) from their nose, and thereafter rating the relative intensity of the malodor on a scale of 5 (maximum) to 0 (no perception). The rating assigned by each sensory panelist was noted. This evaluation was performed prior to addition to any water in any of the three containers.

As reported in the following further Tables, subsequently, the perceived malodor perception of each of the (a) pumpkin puree, the (b) fish sauce and (c) minced garlic dosage samples was separately evaluated immediately prior to the addition of one of the dosage samples to one of the 1 liter class beakers containing the 750 ml of water ("Before adding to water'), and immediately after addition to the water ("t=0 s"), and 30 seconds after addition to water ("t=30 s") and also at 2 minutes ("t=2 min") after addition of a dosage sample to the water. The perceived malodor perception was recorded by the panelist at of the foregoing time intervals.

The foregoing was separately repeated by each of the eight sensory panelists, who provided their individual ratings which are reported on the following further Tables.

The foregoing protocol was also separately repeated by each of the eight sensory panelists, who provided their individual ratings which are reported on the following further Tables, in evaluating the perceived malodor as well as any perceived fragrance from further tests in which a further composition was added, namely one of:

Comparative 2: a single tablet, as supplied by its producer "Pottymint—La Fluer (Jasmine and Honeysuckle)";

Comparative 3: a single tablet, as supplied by its producer of "Alka-Seltzer—Original (unfragranced)";

Comparative 4: two 'pumps' supplied from the sprayer of the "Poo-Pourri—Merry Spritzmas (Peppermint, Vanilla and Citrus) product.

Example 2: a single tablet, having a mass of from 10.5 to 11 grams.

Each of the foregoing Comparative 2, Comparative 3, Comparative 4 and Example 2 compositions were added immediately subsequent to the addition of one of the (a) pumpkin puree, the (b) fish sauce and (c) minced garlic dosage samples to one of the 1 liter containers having the 750 ml. of room temperature water. Again, after the addition of both one of the dosage samples (a), (b) or (c) and one of the Comparative 2, Comparative 3, Comparative 4 or Example 2 compositions, the malodour and fragrance perceptions at the same time intervals was undertaken, and reported by each of the sensory panelists, the results of which are reported on one or more of the following Tables.

TABLE A1

| | Control 1 Evaluation Time | | | |
|---|---|---|---|---|
| Pumpkin Puree | Before adding to water | t = 0 s | t = 30 s | t = 2 min |
| Sensory Panel Malodor Evaluation | 4 | 1 | 1 | 1 |
| | 4 | 3 | 2 | 2 |
| | 3 | 1 | 1 | 1 |
| | 4 | 2 | 1 | 1 |
| | 3 | 1 | 2 | 2 |
| | 4 | 3 | 3 | 3 |
| | 5 | 3 | 2 | 2 |
| | 4 | 0 | 1 | 1 |
| Malodor Mean Evaluation | 3.9 | 1.8 | 1.6 | 1.6 |
| Malodor Mode Evaluation | 4 | 1 | 1 | 1 |
| Malodor Minimum Evaluation | 3 | 0 | 1 | 1 |
| Malodor Maximum Evaluation | 5 | 3 | 3 | 3 |

TABLE A2

| | Control 1 Evaluation Time | | | |
|---|---|---|---|---|
| Fish Sauce | Before adding to water | t = 0 s | t = 30 s | t = 2 min |
| Sensory Panel Malodor Evaluation | 4 | 1 | 1 | 1 |
| | 4 | 3 | 2 | 2 |
| | 3 | 1 | 1 | 1 |
| | 4 | 2 | 1 | 1 |
| | 3 | 1 | 2 | 2 |
| | 4 | 3 | 3 | 3 |
| | 5 | 3 | 2 | 2 |
| | 4 | 0 | 1 | 1 |
| Malodor Mean Evaluation | 3.9 | 1.8 | 1.6 | 1.6 |
| Malodor Mode Evaluation | 4 | 1 | 1 | 1 |
| Malodor Minimum Evaluation | 3 | 0 | 1 | 1 |
| Malodor Maximum Evaluation | 5 | 3 | 3 | 3 |

TABLE A3

| Minced Garlic | Control 1 Evaluation Time: Before adding to water | t = 0 s | t = 30 s | t = 2 min |
|---|---|---|---|---|
| Sensory Panel Malodor Evaluation | 4 | 1 | 1 | 1 |
| | 4 | 3 | 2 | 2 |
| | 3 | 1 | 1 | 1 |
| | 4 | 2 | 1 | 1 |
| | 3 | 1 | 2 | 2 |
| | 4 | 3 | 3 | 3 |
| | 5 | 3 | 2 | 2 |
| | 4 | 0 | 1 | 1 |
| Malodor Mean Evaluation | 3.9 | 1.8 | 1.6 | 1.6 |
| Malodor Mode Evaluation | 4 | 1 | 1 | 1 |
| Malodor Minimum Evaluation | 3 | 0 | 1 | 1 |
| Malodor Maximum Evaluation | 5 | 3 | 3 | 3 |

TABLE B1

| Pumpkin Puree | Comparative 2 (Pottymint - La Fluer) Evaluation Time: Before adding to water | t = 0 s | t = 30 s | t = 2 min |
|---|---|---|---|---|
| Sensory Panel Malodor Evaluation | 4 | 3 | 2 | 2 |
| | 3 | 1 | 1 | 1 |
| | 2 | 1 | 0 | 0 |
| | 3 | 0 | 0 | 3 |
| | 3 | 0 | 0 | 0 |
| | 5 | 2 | 2 | 2 |
| | 5 | 0 | 0 | 2 |
| | 5 | 3 | 0 | 0 |
| Malodor Mean Evaluation | 3.8 | 1.3 | 0.6 | 1.3 |
| Malodor Mode Evaluation | 3 | 0 | 0 | 2 |
| Malodor Minimum Evaluation | 2 | 0 | 0 | 0 |
| Malodor Maximum Evaluation | 5 | 3 | 2 | 3 |
| Sensory Panel Product Evaluation | N/A | 2 | 3 | 3 |
| | N/A | 2 | 2 | 2 |
| | N/A | 0 | 2 | 2 |
| | N/A | 1 | 1 | 2 |
| | N/A | 2 | 3 | 2 |
| | N/A | 3 | 3 | 4 |
| | N/A | 2 | 2 | 2 |
| | N/A | 3 | 4 | 3 |
| Product Mean Evaluation | N/A | 1.9 | 2.5 | 2.5 |
| Product Mode Evaluation | N/A | 2 | 3 | 2 |
| Product Minimum Evaluation | N/A | 0 | 1 | 2 |
| Product Maximum Evaluation | N/A | 3 | 4 | 4 |

TABLE B2

| Fish Sauce | Comparative 2 (Pottymint - La Fluer) Evaluation Time: Before adding to water | t = 0 s | t = 30 s | t = 2 min |
|---|---|---|---|---|
| Sensory Panel Malodor Evaluation | 5 | 4 | 4 | 3 |
| | 5 | 4 | 2 | 2 |
| | 3 | 3 | 3 | 1 |
| | 4 | 3 | 3 | 3 |
| | 5 | 4 | 2 | 2 |
| | 5 | 5 | 5 | 5 |
| | 5 | 4 | 4 | 3 |
| | 5 | 5 | 2 | 2 |

TABLE B2-continued

| Fish Sauce | Comparative 2 (Pottymint - La Fluer) Evaluation Time: Before adding to water | t = 0 s | t = 30 s | t = 2 min |
|---|---|---|---|---|
| Malodor Mean Evaluation | 4.6 | 4.0 | 3.1 | 2.6 |
| Malodor Mode Evaluation | 5 | 4 | 2 | 3 |
| Malodor Minimum Evaluation | 3 | 3 | 2 | 1 |
| Malodor Maximum Evaluation | 5 | 5 | 5 | 5 |
| Sensory Panel Product Evaluation | N/A | 0 | 2 | 3 |
| | N/A | 2 | 1 | 1 |
| | N/A | 0 | 3 | 2 |
| | N/A | 1 | 0 | 0 |
| | N/A | 0 | 0 | 0 |
| | N/A | 0 | 0 | 1 |
| | N/A | 1 | 1 | 1 |
| | N/A | 0 | 2 | 3 |
| Product Mean Evaluation | N/A | 0.5 | 1.1 | 1.4 |
| Product Mode Evaluation | N/A | 0 | 0 | 1 |
| Product Minimum Evaluation | N/A | 0 | 0 | 0 |
| Product Maximum Evaluation | N/A | 2 | 3 | 3 |

TABLE B3

| Minced Garlic | Comparative 2 (Pottymint - La Fluer) Evaluation Time: Before adding to water | t = 0 s | t = 30 s | t = 2 min |
|---|---|---|---|---|
| Sensory Panel Malodor Evaluation | 5 | 4 | 4 | 4 |
| | 5 | 2 | 1 | 1 |
| | 5 | 5 | 5 | 3 |
| | 5 | 4 | 4 | 3 |
| | 5 | 2 | 1 | 1 |
| | 5 | 2 | 3 | 3 |
| | 5 | 3 | 3 | 2 |
| | 5 | 4 | 3 | 3 |
| Malodor Mean Evaluation | 5.0 | 3.3 | 3.0 | 2.5 |
| Malodor Mode Evaluation | 5 | 4 | 3 | 3 |
| Malodor Minimum Evaluation | 5 | 2 | 1 | 1 |
| Malodor Maximum Evaluation | 5 | 5 | 5 | 4 |
| Sensory Panel Product Evaluation | N/A | 0 | 1 | 2 |
| | N/A | 0 | 1 | 1 |
| | N/A | 0 | 1 | 3 |
| | N/A | 0 | 1 | 2 |
| | N/A | 0 | 1 | 1 |
| | N/A | 2 | 3 | 3 |
| | N/A | 3 | 3 | 2 |
| | N/A | 0 | 2 | 3 |
| Product Mean Evaluation | N/A | 0.6 | 1.6 | 2.1 |
| Product Mode Evaluation | N/A | 0 | 1 | 2 |
| Product Minimum Evaluation | N/A | 0 | 1 | 1 |
| Product Maximum Evaluation | N/A | 3 | 3 | 3 |

TABLE C1

| Pumpkin Puree | Comparative 3 (Alka-Seltzer) Evaluation Time: Before adding to water | t = 0 s | t = 30 s | t = 2 min |
|---|---|---|---|---|
| Sensory Panel Malodor Evaluation | 5 | 0 | 2 | 2 |
| | 1 | 1 | 2 | 2 |
| | 5 | 1 | 2 | 2 |
| | 3 | 1 | 1 | 1 |
| | 4 | 2 | 1 | 1 |
| | 3 | 2 | 2 | 2 |
| | 3 | 1 | 1 | 1 |
| | 3 | 2 | 1 | 1 |

TABLE C1-continued

| Pumpkin Puree | Comparative 3 (Alka-Seltzer) Evaluation Time: Before adding to water | t = 0 s | t = 30 s | t = 2 min |
|---|---|---|---|---|
| Malodor Mean Evaluation | 3.4 | 1.3 | 1.5 | 1.5 |
| Malodor Mode Evaluation | 3 | 1 | 2 | 2 |
| Malodor Minimum Evaluation | 1 | 0 | 1 | 1 |
| Malodor Maximum Evaluation | 5 | 2 | 2 | 2 |
| Sensory Panel Product | N/A | 0 | 0 | 0 |
| Evaluation | N/A | 0 | 0 | 0 |
| | N/A | 0 | 0 | 0 |
| | N/A | 0 | 0 | 0 |
| | N/A | 0 | 0 | 0 |
| | N/A | 0 | 0 | 0 |
| | N/A | 0 | 1 | 1 |
| | N/A | 1 | 0 | 0 |
| Product Mean Evaluation | N/A | 0.1 | 0.1 | 0.1 |
| Product Mode Evaluation | N/A | 0 | 0 | 0 |
| Product Minimum Evaluation | N/A | 0 | 0 | 0 |
| Product Maximum Evaluation | N/A | 1 | 1 | 1 |

TABLE C2

| Fish Sauce | Comparative 3 (Alka-Seltzer) Evaluation Time: Before adding to water | t = 0 s | t = 30 s | t = 2 min |
|---|---|---|---|---|
| Sensory Panel Malodor | 5 | 3 | 2 | 2 |
| Evaluation | 3 | 3 | 4 | 4 |
| | 5 | 2 | 2 | 2 |
| | 5 | 2 | 2 | 2 |
| | 5 | 1 | 2 | 2 |
| | 5 | 4 | 4 | 4 |
| | 4 | 1 | 1 | 1 |
| | 5 | 3 | 2 | 2 |
| Malodor Mean Evaluation | 4.6 | 2.4 | 2.4 | 2.4 |
| Malodor Mode Evaluation | 5 | 3 | 2 | 2 |
| Malodor Minimum Evaluation | 3 | 1 | 1 | 1 |
| Malodor Maximum Evaluation | 5 | 4 | 4 | 4 |
| Sensory Panel Product | N/A | 1 | 2 | 2 |
| Evaluation | N/A | 0 | 0 | 0 |
| | N/A | 0 | 0 | 0 |
| | N/A | 0 | 0 | 0 |
| | N/A | 0 | 0 | 0 |
| | N/A | 0 | 0 | 0 |
| | N/A | 2 | 2 | 2 |
| | N/A | 0 | 0 | 0 |
| Product Mean Evaluation | N/A | 0.4 | 0.5 | 0.5 |
| Product Mode Evaluation | N/A | 0 | 0 | 0 |
| Product Minimum Evaluation | N/A | 0 | 0 | 0 |
| Product Maximum Evaluation | N/A | 2 | 2 | 2 |

TABLE C3

| Minced Garlic | Comparative 3 (Alka-Seltzer) Evaluation Time: Before adding to water | t = 0 s | t = 30 s | t = 2 min |
|---|---|---|---|---|
| Sensory Panel Malodor | 5 | 5 | 5 | 5 |
| Evaluation | 5 | 5 | 4 | 4 |
| | 5 | 1 | 2 | 2 |
| | 5 | 1 | 1 | 1 |
| | 5 | 4 | 4 | 4 |
| | 5 | 5 | 4 | 4 |
| | 5 | 4 | 5 | 5 |
| | 5 | 3 | 3 | 3 |
| Malodor Mean Evaluation | 5.0 | 3.5 | 3.5 | 3.5 |
| Malodor Mode Evaluation | 5 | 5 | 4 | 4 |
| Malodor Minimum Evaluation | 5 | 1 | 1 | 1 |

TABLE C3-continued

| Minced Garlic | Comparative 3 (Alka-Seltzer) Evaluation Time: Before adding to water | t = 0 s | t = 30 s | t = 2 min |
|---|---|---|---|---|
| Malodor Maximum Evaluation | 5 | 5 | 5 | 5 |
| Sensory Panel Product | N/A | 0 | 0 | 0 |
| Evaluation | N/A | 0 | 0 | 0 |
| | N/A | 0 | 0 | 0 |
| | N/A | 0 | 0 | 0 |
| | N/A | 0 | 0 | 0 |
| | N/A | 0 | 0 | 0 |
| | N/A | 0 | 0 | 0 |
| | N/A | 0 | 0 | 0 |
| | N/A | 1 | 0 | 0 |
| Product Mean Evaluation | N/A | 0.1 | 0.0 | 0.0 |
| Product Mode Evaluation | N/A | 0 | 0 | 0 |
| Product Minimum Evaluation | N/A | 0 | 0 | 0 |
| Product Maximum Evaluation | N/A | 1 | 0 | 0 |

TABLE D1

| Pumpkin Puree | Comparative 4 (Poo-Pourri) Evaluation Time: Before adding to water | t = 0 s | t = 30 s | t = 2 min |
|---|---|---|---|---|
| Sensory Panel Malodor | 4 | 0 | 0 | 0 |
| Evaluation | 4 | 1 | 1 | 1 |
| | 3 | 0 | 0 | 0 |
| | 4 | 0 | 1 | 2 |
| | 5 | 0 | 0 | 0 |
| | 3 | 1 | 0 | 0 |
| | 5 | 0 | 0 | 0 |
| | 4 | 0 | 0 | 0 |
| Malodor Mean Evaluation | 4.0 | 0.3 | 0.3 | 0.4 |
| Malodor Mode Evaluation | 4 | 0 | 0 | 0 |
| Malodor Minimum Evaluation | 3 | 0 | 0 | 0 |
| Malodor Maximum Evaluation | 5 | 1 | 1 | 2 |
| Sensory Panel Product | N/A | 3 | 3 | 3 |
| Evaluation | N/A | 5 | 3 | 2 |
| | N/A | 3 | 3 | 4 |
| | N/A | 3 | 2 | 2 |
| | N/A | 5 | 5 | 5 |
| | N/A | 5 | 4 | 3 |
| | N/A | 4 | 4 | 3 |
| | N/A | 4 | 5 | 5 |
| Product Mean Evaluation | N/A | 4.0 | 3.6 | 3.4 |
| Product Mode Evaluation | N/A | 3 | 3 | 3 |
| Product Minimum Evaluation | N/A | 3 | 2 | 2 |
| Product Maximum Evaluation | N/A | 5 | 5 | 5 |

TABLE D2

| Fish Sauce | Comparative 4 (Poo-Pourri) Evaluation Time: Before adding to water | t = 0 s | t = 30 s | t = 2 min |
|---|---|---|---|---|
| Sensory Panel Malodor | 5 | 0 | 0 | 1 |
| Evaluation | 4 | 0 | 0 | 0 |
| | 3 | 2 | 1 | 1 |
| | 5 | 1 | 1 | 2 |
| | 5 | 0 | 1 | 1 |
| | 5 | 1 | 1 | 2 |
| | 5 | 1 | 2 | 1 |
| | 4 | 1 | 0 | 2 |
| Malodor Mean Evaluation | 4.5 | 0.8 | 0.8 | 1.3 |
| Malodor Mode Evaluation | 5 | 1 | 1 | 1 |
| Malodor Minimum Evaluation | 3 | 0 | 0 | 0 |
| Malodor Maximum Evaluation | 5 | 2 | 2 | 2 |
| Sensory Panel Product | N/A | 3 | 3 | 2 |
| Evaluation | N/A | 3 | 3 | 2 |

TABLE D2-continued

| Fish Sauce | Comparative 4 (Poo-Pourri) Evaluation Time | | | |
|---|---|---|---|---|
| | Before adding to water | t = 0 s | t = 30 s | t = 2 min |
| | N/A | 3 | 3 | 4 |
| | N/A | 2 | 2 | 1 |
| | N/A | 5 | 4 | 3 |
| | N/A | 3 | 3 | 2 |
| | N/A | 2 | 1 | 1 |
| | N/A | 4 | 3 | 2 |
| Product Mean Evaluation | N/A | 3.1 | 2.8 | 2.1 |
| Product Mode Evaluation | N/A | 3 | 3 | 2 |
| Product Minimum Evaluation | N/A | 2 | 1 | 1 |
| Product Maximum Evaluation | N/A | 5 | 4 | 4 |

TABLE D3

| Minced Garlic | Comparative 4 (Poo-Pourri) Evaluation Time | | | |
|---|---|---|---|---|
| | Before adding to water | t = 0 s | t = 30 s | t = 2 min |
| Sensory Panel Malodor Evaluation | 5 | 0 | 0 | 0 |
| | 5 | 3 | 3 | 4 |
| | 5 | 4 | 2 | 2 |
| | 5 | 3 | 2 | 1 |
| | 5 | 0 | 1 | 2 |
| | 5 | 4 | 2 | 2 |
| | 5 | 1 | 0 | 1 |
| | 5 | 0 | 2 | 1 |
| Malodor Mean Evaluation | 5.0 | 1.9 | 1.5 | 1.6 |
| Malodor Mode Evaluation | 5 | 0 | 2 | 2 |
| Malodor Minimum Evaluation | 5 | 0 | 0 | 0 |
| Malodor Maximum Evaluation | 5 | 4 | 3 | 4 |
| Sensory Panel Product Evaluation | N/A | 4 | 4 | 3 |
| | N/A | 3 | 2 | 2 |
| | N/A | 4 | 3 | 2 |
| | N/A | 2 | 1 | 1 |
| | N/A | 4 | 3 | 3 |
| | N/A | 4 | 2 | 1 |
| | N/A | 3 | 2 | 1 |
| | N/A | 5 | 2 | 3 |
| Product Mean Evaluation | N/A | 3.6 | 2.4 | 2.0 |
| Product Mode Evaluation | N/A | 4 | 2 | 3 |
| Product Minimum Evaluation | N/A | 2 | 1 | 1 |
| Product Maximum Evaluation | N/A | 5 | 4 | 3 |

TABLE E1

| Pumpkin Puree | Ex. 2 tablet Evaluation Time | | | |
|---|---|---|---|---|
| | Before adding to water | t = 0 s | t = 30 s | t = 2 min |
| Sensory Panel Malodor Evaluation | 3 | 2 | 0 | 0 |
| | 4 | 0 | 1 | 1 |
| | 5 | 0 | 0 | 0 |
| | 4 | 0 | 0 | 1 |
| | 4 | 0 | 0 | 0 |
| | 3 | 0 | 0 | 0 |
| | 4 | 1 | 1 | 0 |
| | 4 | 1 | 1 | 1 |
| Malodor Mean Evaluation | 3.9 | 0.5 | 0.4 | 0.4 |
| Malodor Mode Evaluation | 4 | 0 | 0 | 0 |
| Malodor Minimum Evaluation | 3 | 0 | 0 | 0 |
| Malodor Maximum Evaluation | 5 | 2 | 1 | 1 |
| Sensory Panel Product Evaluation | N/A | 2 | 3 | 4 |
| | N/A | 2 | 1 | 4 |
| | N/A | 3 | 3 | 3 |
| | N/A | 1 | 3 | 3 |
| | N/A | 4 | 4 | 4 |

TABLE E1-continued

| Pumpkin Puree | Ex. 2 tablet Evaluation Time | | | |
|---|---|---|---|---|
| | Before adding to water | t = 0 s | t = 30 s | t = 2 min |
| | N/A | 2 | 3 | 3 |
| | N/A | 4 | 3 | 2 |
| | N/A | 3 | 4 | 4 |
| Product Mean Evaluation | N/A | 2.6 | 3.0 | 3.4 |
| Product Mode Evaluation | N/A | 2 | 3 | 4 |
| Product Minimum Evaluation | N/A | 1 | 1 | 2 |
| Product Maximum Evaluation | N/A | 4 | 4 | 4 |

TABLE E2

| Fish Sauce | Ex. 2 tablet Evaluation Time | | | |
|---|---|---|---|---|
| | Before adding to water | t = 0 s | t = 30 s | t = 2 min |
| Sensory Panel Malodor Evaluation | 5 | 0 | 0 | 1 |
| | 4 | 0 | 0 | 0 |
| | 3 | 2 | 1 | 1 |
| | 5 | 1 | 1 | 2 |
| | 5 | 0 | 1 | 1 |
| | 5 | 1 | 1 | 2 |
| | 5 | 1 | 2 | 1 |
| | 4 | 1 | 0 | 2 |
| Malodor Mean Evaluation | 4.5 | 0.8 | 0.8 | 1.3 |
| Malodor Mode Evaluation | 5 | 1 | 1 | 1 |
| Malodor Minimum Evaluation | 3 | 0 | 0 | 0 |
| Malodor Maximum Evaluation | 5 | 2 | 2 | 2 |
| Sensory Panel Product Evaluation | N/A | 3 | 3 | 2 |
| | N/A | 3 | 3 | 2 |
| | N/A | 3 | 3 | 4 |
| | N/A | 2 | 2 | 1 |
| | N/A | 5 | 4 | 3 |
| | N/A | 3 | 3 | 2 |
| | N/A | 2 | 1 | 1 |
| | N/A | 4 | 3 | 2 |
| Product Mean Evaluation | N/A | 3.1 | 2.8 | 2.1 |
| Product Mode Evaluation | N/A | 3 | 3 | 2 |
| Product Minimum Evaluation | N/A | 2 | 1 | 1 |
| Product Maximum Evaluation | N/A | 5 | 4 | 4 |

TABLE E3

| Minced Garlic | Ex. 2 tablet Evaluation Time | | | |
|---|---|---|---|---|
| | Before adding to water | t = 0 s | t = 30 s | t = 2 min |
| Sensory Panel Malodor Evaluation | 5 | 0 | 0 | 0 |
| | 5 | 3 | 3 | 4 |
| | 5 | 4 | 2 | 2 |
| | 5 | 3 | 2 | 1 |
| | 5 | 0 | 1 | 2 |
| | 5 | 4 | 2 | 2 |
| | 5 | 1 | 0 | 1 |
| | 5 | 0 | 2 | 1 |
| Malodor Mean Evaluation | 5.0 | 1.9 | 1.5 | 1.6 |
| Malodor Mode Evaluation | 5 | 0 | 2 | 2 |
| Malodor Minimum Evaluation | 5 | 0 | 0 | 0 |
| Malodor Maximum Evaluation | 5 | 4 | 3 | 4 |
| Sensory Panel Product Evaluation | N/A | 4 | 4 | 3 |
| | N/A | 3 | 2 | 2 |
| | N/A | 4 | 3 | 2 |
| | N/A | 2 | 1 | 1 |
| | N/A | 4 | 3 | 3 |
| | N/A | 3 | 2 | 1 |
| | N/A | 5 | 2 | 3 |

TABLE E3-continued

| Minced Garlic | Ex. 2 tablet Evaluation Time | | | |
|---|---|---|---|---|
| | Before adding to water | t = 0 s | t = 30 s | t = 2 min |
| Product Mean Evaluation | N/A | 3.6 | 2.4 | 2.0 |
| Product Mode Evaluation | N/A | 4 | 2 | 3 |
| Product Minimum Evaluation | N/A | 2 | 1 | 1 |
| Product Maximum Evaluation | N/A | 5 | 4 | 3 |

As can be seen from the foregoing the Example 2 composition (tablet) provided excellent amelioration of the malodors, as well as a good fragrancing benefit.

Test: Dissolution/Reaction Rate:

Several tablets formed from the effervescent composition identified as Ex. 2 were formed into tablets, and their dissolution rate in laboratory beaker containing 1 litre of room temperature water was evaluated for the dissolution rate at which the tablets effervesced and were totally dissolved. The results of this testing are identified in the following Table 3:

TABLE 3

| | Tablet 1 | Tablet 2 | Tablet 3 |
|---|---|---|---|
| water temperature: | 67.1° F. | 67.5° F. | 69.1° F. |
| tablet mass: | 6.804 g | 6.995 g | 6.524 g |
| time to total dissolution: | 38.47 seconds | 35.77 seconds | 31.15 seconds |
| dissolution rate(mass)/second | 0.1769 g/seconds | 0.1955 g/seconds | 0.2094 g/s |

As evidenced from the foregoing, each of the tested tablets exhibited a rapid dissolution rate, and rapid overall dissolution.

Test: pH Change

Several tablets formed of the effervescent composition identified as Ex. 2 were formed into tablets, and the resultant change in pH of 1 litre of room temperature water in laboratory beaker containing 1 litre of was evaluated; the results are indicated in the following Table 4:

TABLE 4

| | Tablet 1 | Tablet 2 | Tablet 3 |
|---|---|---|---|
| Water Temperature (° F.) | 73.1 | 72.5 | 72.2 |
| pH of water before tablet is added | 7.85 | 7.72 | 7.67 |
| pH of water after tablet is added | 6.32 | 6.19 | 6.19 |
| Change in pH | −1.53 | −1.53 | −1.48 |

As is seen from the foregoing the dissolved tablets formed from the effervescing composition of Ex. 2 acidified the water from its original pH.

The invention claimed is:

1. A substantially anhydrous effervescing composition in the form of a tablet having a mass of at least about 3 grams comprising the following constituents:

35-55% wt. of an alkali component of a gas generator system;

15-35% wt. of an acid component of the gas generator system, 10-30% wt. of a bulking constituent;

1.5-12% wt. of a starch;

0.005-3% wt. of a proteolytic enzyme;

0.1-5.5% wt. of a fragrance;

0.5-3% wt. water.

2. A method of controlling the emanation of malodors from a toilet into the ambient environment, the method comprising the step of:

depositing the effervescing composition of claim 1 into the water present in a toilet bowl, causing the formation of a foam within the toilet bowl and concurrently delivering fragrance to the to the headspace and ambient environment of the toilet bowl.

3. The effervescing composition of claim 1, wherein the acid component selected from: citric acid, maleic acid, fumaric acid, aspartic acid, glutaric acid, tartaric acid, succinic acid, adipic acid, monosodium phosphate, boric acid and mixtures thereof.

4. The effervescing composition of claim 1, wherein the acid component and the alkali component are present in a respective stochiometric ratio of 1-5:1-5.

5. The method of claim 2, wherein the depositing of the effervescing composition occurs within 90 second prior to the use of the toilet bowl by a consumer.

6. The method of claim 2, wherein the effervescing composition, subsequent to its disintegration, forms a hydrophobic layer upon the surface of the water present in the toilet bowl.

7. The method of claim 6, wherein the effervescing composition, when added to 750 ml of water having a temperature of between about 67° F. to about 69° F., exhibits a mass dissolution rate of between about 0.17-0.21 grams/second, until total dissolution of the solid dosage form in the water.

8. The method of claim 6, wherein the effervescing composition has a mass of between about 6.5-7 grams.

9. The effervescing composition of claim 1, having a mass of about 3-10 grams.

10. The effervescing composition of claim 1 provided within an overwrap of a water impermeable material.

11. The effervescing composition of claim 1, wherein the three-dimensional solid form has an outer surface which is coated with a water soluble polymer or a water soluble material which limits the transmission of ambient air humidity.

* * * * *